United States Patent [19]

Ishizuka et al.

[11] Patent Number: 4,973,271

[45] Date of Patent: Nov. 27, 1990

[54] LOW INSERTION-FORCE TERMINAL

[75] Inventors: Shigeo Ishizuka; Katsutoshi Kuzuno; Kazuaki Sakurai, all of Shizuoka, Japan

[73] Assignee: Yazaki Corporation, Tokyo, Japan

[21] Appl. No.: 461,499

[22] Filed: Jan. 5, 1990

[30] Foreign Application Priority Data

Jan. 30, 1989 [JP] Japan ..... 1-17772

[51] Int. Cl.[5] ..... H01R 4/48

[52] U.S. Cl. ..... 439/839; 439/833; 439/849

[58] Field of Search ..... 439/816, 818, 820, 821, 439/830, 833, 836, 839, 837, 843, 851–857, 848, 849

[56] References Cited

U.S. PATENT DOCUMENTS

| | | | |
|---|---|---|---|
| 3,663,931 | 5/1972 | Brown | 439/857 |
| 3,836,947 | 9/1974 | Yeager | 439/839 |
| 4,560,231 | 12/1985 | Shirai | 439/851 |
| 4,699,444 | 10/1987 | Isohata | 439/839 |

FOREIGN PATENT DOCUMENTS

| | | | |
|---|---|---|---|
| 2455140 | 5/1976 | Fed. Rep. of Germany | 439/833 |
| 2226093 | 11/1974 | France | 439/833 |
| 8903129 | 4/1989 | PCT Int'l Appl. | 439/839 |

*Primary Examiner*—David L. Pirlot

*Attorney, Agent, or Firm*—Sughrue, Mion, Zinn, Macpeak & Seas

[57] ABSTRACT

A low insertion-force electrical contact female terminal characterized in that a distal end portion of a flexible base plate portion is folded back to provide a resilient contact portion. A movable support member is mounted on the terminal body and moves in the longitudinal direction of the base plate portion to provide a force to the base plate portion. The flexible base plate portion flexes in response to the force and the integrally attached resilient contact portion also flexes to facilitate entry of a mating male electrical contact terminal. Once the female and male terminals have been connected, the movable support member can be moved again to provide a maximum force to maintain a strong connection.

6 Claims, 6 Drawing Sheets

LOW INSERTION-FORCE TERMINAL

BACKGROUND OF THE INVENTION

This invention relates to a low insertion-force terminal which is designed to reduce the force required for the insertion of a mating electrical connection terminal so as to facilitate the insertion of the terminal, and to provide a strong electrical connection.

FIG. 7 is a perspective view of a conventional female electrical connection terminal. More specifically, a resilient contact portion 33 having spring-like properties is provided within a box-like terminal body 32, the contact portion 33 being formed integrally with the body 32. A male terminal (not shown) is inserted between the resilient contact portion 33 and a terminal contact portion 34 of the female terminal, thereby making electrical connection between the male and female terminals. In FIG. 7, reference numeral 12 denotes a wire connection portion, reference numeral 13 a bare wire-holding section, and reference numeral 14 a sheathed wire-holding section.

With this construction, however, as the size of the terminal is increased, a greater force is required for the insertion of the male terminal into the female terminal, thus making the connecting operation more difficult.

SUMMARY OF THE INVENTION

With the above problems in view, it is an object of this invention to provide a female connection terminal which enables an easy insertion of a male terminal even if the size of the terminals is large, and to provide a proper terminal contact force.

The above object has been achieved by a low insertion-force terminal characterized in that a distal end portion of a base plate portion is folded back to provide a resilient contact portion integral with the base plate portion; and a movable support member is mounted on a terminal body to which the base plate portion is integrally connected at its proximal end, and is disposed in opposed relation to the base plate portion so that the movable support member can be movable in the longitudinal direction of the base plate portion.

The movable support member can have a spring portion abuttable against the base plate portion.

Notched grooves can be formed in either those portions of the terminal body opposed to each other in a direction intersecting the base plate portion or the movable support member, the notched grooves extending in the longitudinal direction of the base plate portion, and there being provided projections formed on the other of the just-mentioned portions of the terminal body and the movable support member, the projections being engageable respectively in the notched projections being engageable respectively in the notched grooves.

Groove-like bent portions can be formed on either those portions of the terminal body opposed to each other in a direction intersecting the base plate portion or the movable support member, the groove-like bent portions extending in the longitudinal direction of the base plate portion, and there being provided projections formed on the other of the just-mentioned portions of the terminal body and the movable support member, the projections being engageable respectively in the groove-like bent portions.

When a mating male terminal is to be connected to the female terminal, the movable support member is positioned, for example, at the proximal end portion of the base plate portion, so that the base plate portion is supported in a cantilever manner. As the insertion of the mating male terminal proceeds, the resilient contact portion is flexed together with the base plate portion, thereby reducing the terminal insertion force.

A suitable terminal contact force can be obtained by moving the movable support member to a suitable position.

Further, if the movable support member is provided with a spring portion, the terminal contact force can be further increased.

BRIEF DESCRIPTION OF THE DRAWINGS

FIG. 5(*c*) is a horizontal cross-sectional view of another preferred embodiment of the invention;

DESCRIPTION OF THE PREFERRED EMBODIMENTS

Figure 1:
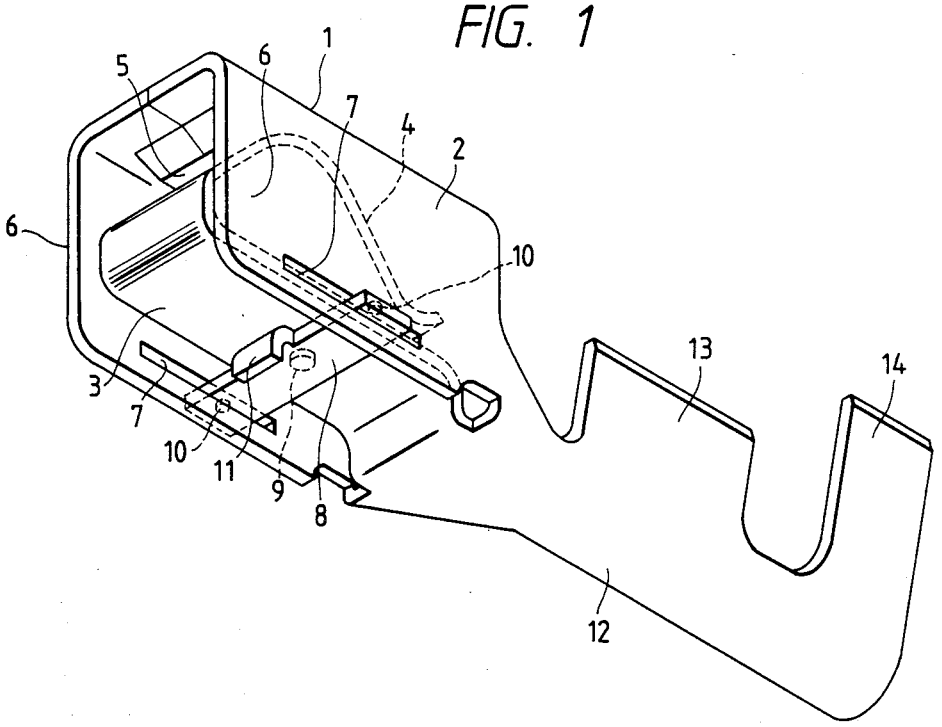
FIG. 1 is a perspective view of a preferred embodiment of the invention.

FIG. 1 is a perspective view of one preferred embodiment of a low insertion-force terminal of the present invention.

More specifically, an electrical contact portion 1, into which a mating male tab terminal (not shown) is adapted to be inserted, has a bottom wall which is separated at its opposite sides from the opposite side walls of a box-like terminal body 2 to provide a base plate portion 3 which is flexible vertically. The base plate portion 3 is folded back at its distal portion to provide a resilient contact portion 4 having spring-like properties. A terminal contact portion 5 is formed at the upper wall of the terminal body 2 in opposed relation to the resilient contact portion 4.

A notched groove 7 is formed longitudinally through each of the opposite side walls 6 of the terminal body 2 disposed respectively on the opposite sides of the resilient contact portion 4. A movable support member 8 is movably received in the notched grooves 7, and is disposed in opposed relation to the base plate portion 3. A projection 9 is formed at the central portion of the movable support member 8, and is held against the base plate portion 3. Retaining projections 10 are formed respectively on the opposite sides of the movable support member 8, and a thumbpiece 11 is formed on the end of the movable support member 8 facing the terminal insertion side.

In FIG. 1, reference numeral 12 denotes a wire connection portion, reference numeral 13 a bare wire-holding section, and reference numeral 14 a sheathed wire-holding section.

Figure 2A:
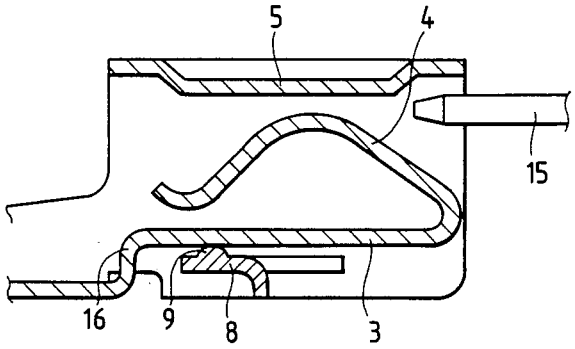
FIGS. 2(*a*) and 2(*b*) are cross-sectional views thereof illustrative of the operation thereof.
Figure 2B:
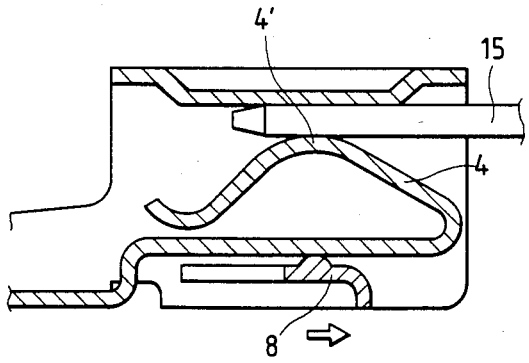

FIGS. 2(*a*) and 2(*b*) are cross-sectional views illustrative of the operation of the above embodiment.

FIG. 2(*a*) shows the condition prior to the insertion of the male tab terminal 15, in which the movable support member 8 is positioned adjacent to a proximal end 16 of the base plate portion 3. Namely, the base plate portion 3 is kept in a condition to be easily flexed vertically. In this condition, when the male tab terminal 15 is inserted, the male tab terminal 15 is brought into engagement with the resilient contact portion 4 to press down the base plate portion 3. Thus, the male tab terminal 15 can be easily inserted. Incidentally, at this time, oxide films on the terminal surfaces 5 and 15 are removed by the sliding contact therebetween, as is the prior art.

FIG. 2(*b*) shows the condition after the insertion of the male tab terminal 15, in which the movable support member 8 is moved to a position beneath the apex 4' of the resilient contact portion 4, thereby achieving the maximum contact force.

Figure 3A:
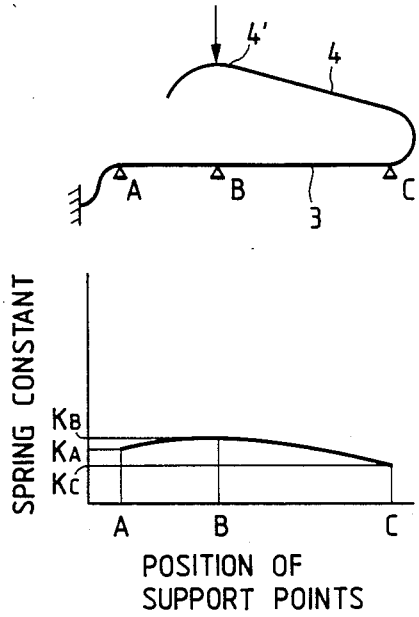
FIGS. 3(*a*), 3(*b*) and 3(*c*) are views illustrative of the relationship between the position of the support point and the spring constant.
Figure 3B:
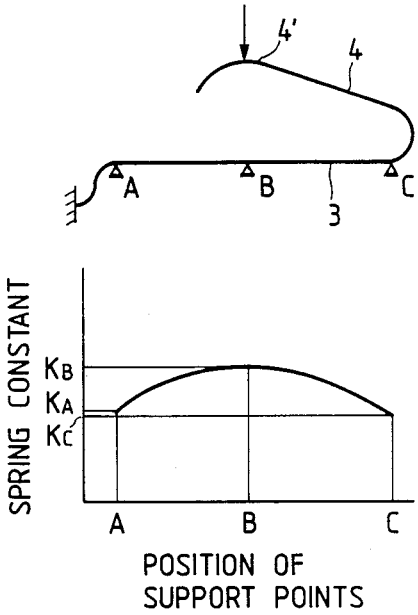
Figure 3C:
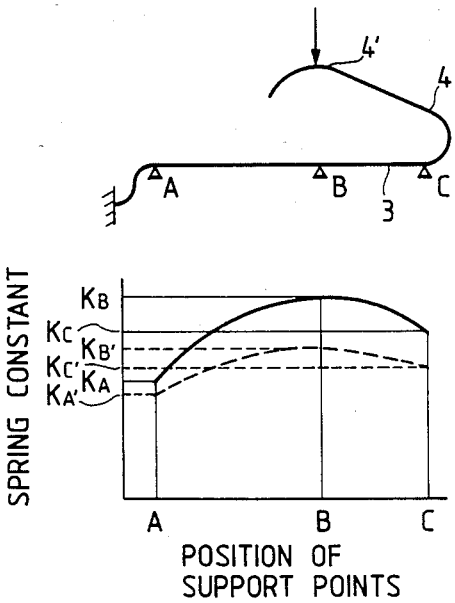

FIGS. 3(*a*), 3(*b*) and 3(*c*) show the relationships between the support points A, B, C and the spring constants $K_A$, $K_B$, $K_C$. The spring constant and hence the contact force are at a maximum when the support point (that is, the movable support member 8) is disposed at a position B beneath the apex 4' of the resilient contact portion 4. Further, in accordance with the position of the apex 4' with respect to the base plate portion 3, the spring constant greatly varies depending on whether the support point is disposed at the proximal end A or the distal end C of the base plate portion 3. Therefore, in connection with the insertion of the male tab terminal 15, preferably, it is predetermined as a standard condition whether the movable support member 8 is positioned at the proximal end A or the distal end C of the base plate portion 3.

Figure 4:
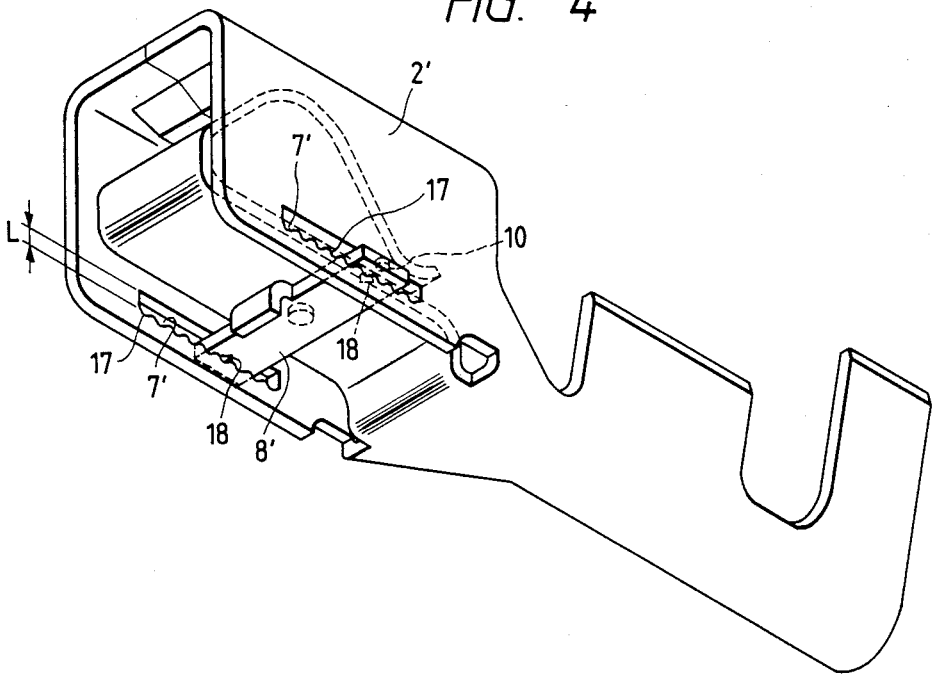
FIG. 4 is a perspective view of a modification of the embodiment of FIG. 1.

FIG. 4 shows a modification of the embodiment of FIG. 1, in which a movable support member 8' can be retained with respect to notched grooves 7' formed through a terminal body 2'.

More specifically, serrations 17 are formed on the lower edge of each of the two notched grooves 7', and a pair of protuberances 18 each engageable with a respective one of the serrated edges 17 are formed on the lower surface of the movable support member 8' at the opposite side portions thereof. This arrangement facilitates the positioning of the movable support member 8', and prevents the movable support member 8' from being displaced out of position. In FIG. 4, a vertical width L of the notched groove 7' is greater than the sum of the thickness of the movable support member 8' and the height of the protuberance 18, thus providing a clearance to enable the movable support member 8' to be lifted upwardly. Therefore, when the movable support member 8' is to be moved, the protuberances 18 can be slidingly moved over the serrated edges 17, respectively.

Figure 5A:
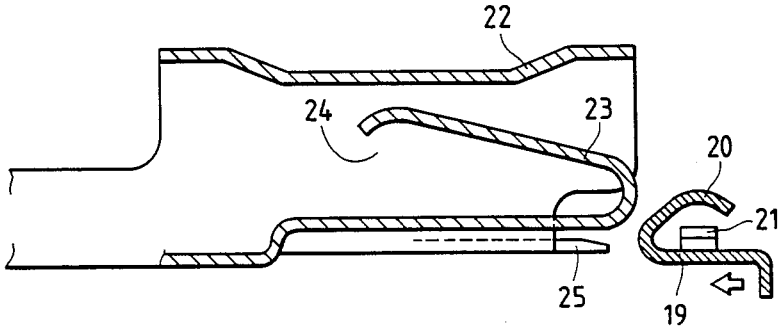
FIGS. 5(*a*) and 5(*b*) are vertical cross-sectional views of another preferred embodiment of the invention.
Figure 5B:
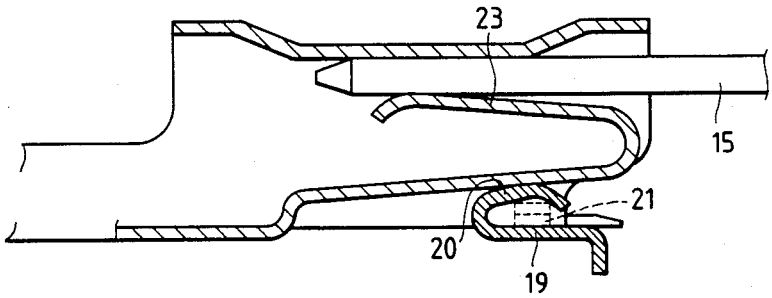
Figure 5C:
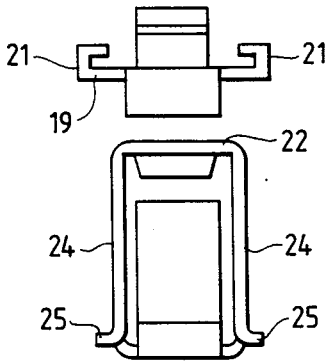
Figure 6A:
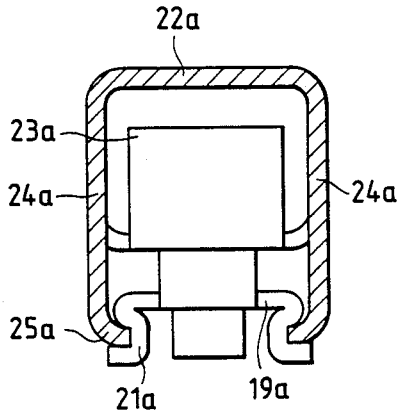
FIGS. 6(*a*), 6(*b*), 6(*c*) and 6(*d*) are end views of modifications of the embodiment of FIG. 5, respectively.
Figure 6B:
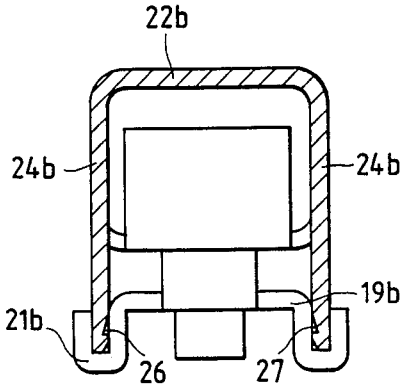
Figure 6C:
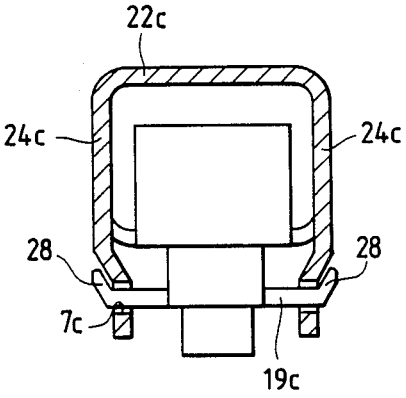
Figure 6D:
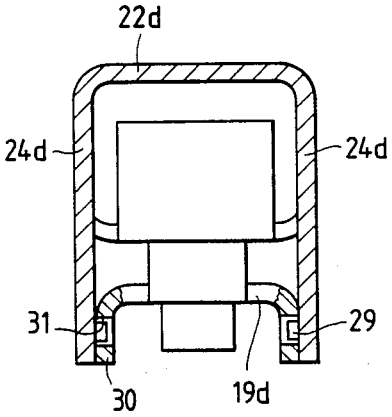
Figure 7:
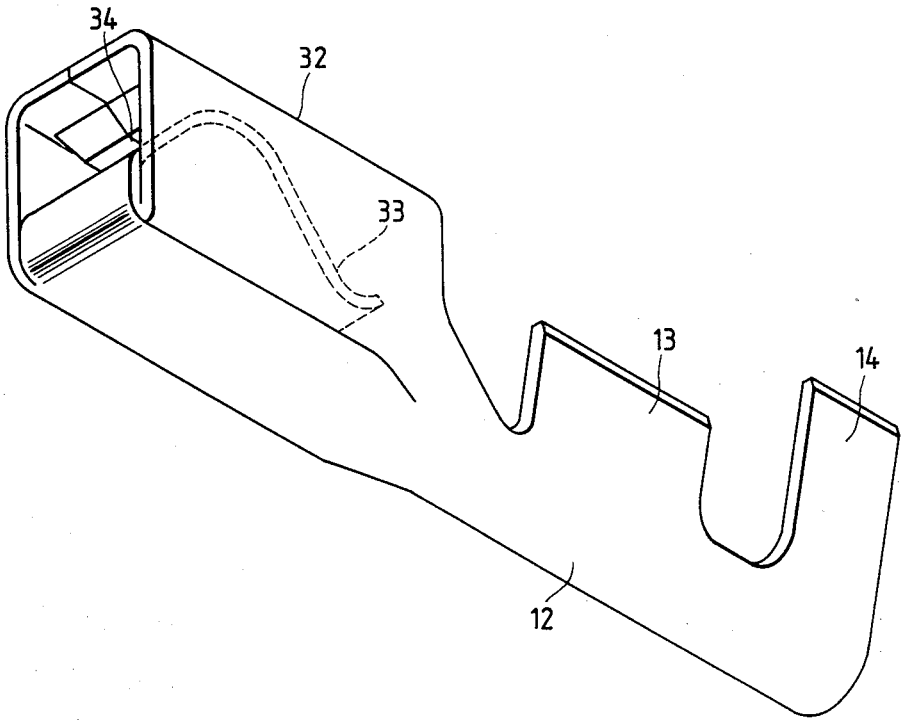
FIG. 7 is a perspective view of the prior art.

FIGS. 5(*a*), 5(*b*) and 5(*c*) show another preferred embodiment of a low insertion-force terminal of the invention.

More specifically, this embodiment is characterized in that a movable support member 19 is provided with a spring-like portion 20. The movable support member 19 is folded back at its insertion-side portion to provide the spring portion 20. The opposite lateral sides of the movable support member 19 are bent inwardly as shown in FIG. 5(*c*) to provide a pair of groove-like bent portions 21. Opposite side walls 24 of a terminal body 22 disposed respectively on opposite sides of a resilient contact portion 23 are bent outwardly at their lower ends to provide rail-like projections 25. The groove-like bent portions 21 are fitted respectively on the projections 25 so as to slide therealong to a suitable position.

It is preferred that the movable support member 19 be attached to the terminal body 22 before a male tab terminal 15 is inserted. In this case, as indicated by a broken line in FIG. 3(*c*), the spring constants $K_A'$ to $K_C'$ can be kept to a small value, and therefore the terminal insertion force can be further lowered. Further, the spring constant ratio can be freely changed by the spring constant of the spring portion 20. (In the Figure, the rate of change of the spring constant ratio is $K_A'/K_A > K_C'/K_C$). Further, the terminal contact force can be increased.

FIGS. 6(*a*) to 6(*d*) are modifications of the movable support member 19 shown in FIG. 5(*c*), respectively.

In FIG. 6(*a*), opposite side walls 24*a* of a terminal body 22*a* disposed respectively on opposite sides of a resilient contact portion 23*a* are bent inwardly at their lower ends to provide rail-like projections 25*a*. Opposite sides of a movable support member 19*a* are bent inwardly and further bent outwardly to provide groove-like bent portions 21*a*. The groove-like bent portions 21*a* are slidably fitted on the projections 25*a* of the terminal body 22, respectively.

In FIG. 6(*b*), grooves 26 are formed respectively on opposite side walls 24*b* of a terminal body 22*b* and extend in the longitudinal direction of the terminal body 22*b*. A movable support member 19*b* has a pair of groove-like bent portions 21*b* of a channel-shaped cross-section at opposite sides thereof. A pair of protuberances 27 engageable respectively with the grooves 26 are formed respectively on the inner surfaces of the groove-like bent portions 21*b*.

In FIG. 6(*c*), a pair of notched grooves 7*c* are formed respectively through opposite side walls 24*c* of a terminal body 22*c*, and opposite side portions 28 of a movable support member 19*c* are bent into a tapered configuration conforming with the configuration of the opposite side walls 24*c*. The movable support member 19*c* is received in the notched grooves 7*c*.

In FIG. 6(*d*), a pair of rail-like projections 29 are formed respectively on the inner surfaces of opposite side walls 24*d* of a terminal body 22*d*. A movable support member 19*d* has extended opposite side walls 30. A pair of notched grooves 31 are formed through the opposite side walls 30, respectively, and the projections 29 are engageable in the notched grooves 31, respectively.

The arrangements shown in FIGS. 5(*c*), 6(*b*), and 6(*c*) have the advantage that even if one of the opposite side walls (24, 24*b*, 24*c*) of the terminal body (22, 22*b*, 22*c*) is opened outwardly, the movable support member (19, 19*b*, 19*c*) will not be disengaged from the terminal body. The arrangements of FIGS. 6(*a*) and 6(*d*) have the advantage that the movable support member (19*a*, 19*d*) can be easily attached to the terminal body (22*a*, 22*d*).

As described above, in the present invention, even if the terminal has an increased size, the insertion of the male terminal can be carried out easily, and also a suitable terminal contact force can be obtained. Therefore, the burden imposed on the operator when carrying out the terminal connection operation is reduced, and the reliability of the electrical connection is enhanced.

We claim:

1. A low insertion-force terminal comprising:

an electrical contact portion having a terminal contact portion;

a pair of side walls extending substantially perpendicularly from said terminal contact portion;

a base plate portion provided on the side opposite to said terminal contact portion and having a flexibility in a direction parallel to said side walls, said base plate portion being folded back at its distal portion to provide a resilient contact portion having spring-like properties, said resilient contact portion being disposed in opposed relation to said terminal contact portion; and means for applying a terminal contact force, said means having a movable support member movable in the longitudinal direction of said base plate portion.

2. A low insertion-force terminal according to claim 1, in which said movable support member has a spring-like portion abuttable against said base plate portion.

3. A low insertion-force terminal according to claim 1, in which said means includes longitudinal notched grooves formed in either said side walls or said movable support member, and projections formed on the other, said projections being engageable in said notched grooves, respectively.

4. A low insertion-force terminal according to claim 3, in which a protuberance is provided on one of said notched groove and said projection, an engaging groove engageable with said protuberance being provided on the other.

5. A low insertion-force terminal according to claim 1, in which said means includes longitudinal groove-like bent portions formed on either said side walls or said movable support member, and projections formed on the other, said projections being engageable in said groove-like bent portions, respectively.

6. A low insertion-force terminal according to claim 5, in which a protuberance is provided on one of said groove-like bent portion and said projection, an engaging groove engageable with said protuberance being provided on the other.

* * * * *